US006711907B2

(12) United States Patent
Dinnage et al.

(10) Patent No.: US 6,711,907 B2
(45) Date of Patent: Mar. 30, 2004

(54) DESICCANT REFRIGERANT DEHUMIDIFIER SYSTEMS

(75) Inventors: Paul A. Dinnage, Stratham, NH (US); Kevin H. Young, Newmarket, NH (US)

(73) Assignee: Munters Corporation, Amesbury, MA (US)

( * ) Notice: Subject to any disclaimer, the term of this patent is extended or adjusted under 35 U.S.C. 154(b) by 0 days.

(21) Appl. No.: 10/316,952

(22) Filed: Dec. 12, 2002

(65) Prior Publication Data

US 2003/0121271 A1 Jul. 3, 2003

Related U.S. Application Data

(63) Continuation-in-part of application No. 09/795,818, filed on Feb. 28, 2001.

(51) Int. Cl.[7] ..... F25D 17/06; F25D 23/00
(52) U.S. Cl. ..... 62/94; 62/271
(58) Field of Search ..... 62/94, 271, DIG. 17

(56) References Cited

U.S. PATENT DOCUMENTS 4,180,985 A 1/1980 Northrup, Jr. ..... 62/94
4,474,021 A * 10/1984 Harband ..... 62/94
4,936,107 A * 6/1990 Kitagaki et al. ..... 62/184
5,517,828 A * 5/1996 Calton et al. ..... 62/271
5,761,923 A * 6/1998 Maeda ..... 62/271
5,816,065 A * 10/1998 Maeda ..... 62/271
5,931,016 A * 8/1999 Yoho, Sr. ..... 62/271
6,141,979 A * 11/2000 Dunlap ..... 62/176.6
6,557,365 B2 * 5/2003 Dinnage et al. ..... 62/271

FOREIGN PATENT DOCUMENTS

EP 0191007 8/1986

* cited by examiner

*Primary Examiner*—William C. Doerrler
(74) *Attorney, Agent, or Firm*—Fitzpatrick, Cella, Harper & Scinto

(57) ABSTRACT

A method for conditioning air for an enclosure in which a supply air stream is cooled with a refrigerant system containing a variable compressor by passing the air over a cooling coil to reduce the temperature thereof; the thus cooled supply air stream is then passed through a segment of a rotating desiccant wheel under conditions which increase its temperature and reduce its moisture content, and then delivered to the enclosure. The desiccant wheel is regenerated by heating a regeneration air stream with the condensing coil of the refrigerant system, and then passing the heated regeneration air stream through another segment of the rotating desiccant wheel. At least one condition of the supply air stream, the regeneration air stream, and/or the refrigerant system is sensed or monitored and the output of the compressor is controlled in response to the sensed condition.

4 Claims, 14 Drawing Sheets

DESICCANT REFRIGERANT DEHUMIDIFIER SYSTEMS

This application is a continuation in part of U.S. patent application Ser. No. 09/795,818 filed Feb. 28, 2001, the disclosure of which is incorporated herein by reference.

BACKGROUND OF THE INVENTION

Field of the Invention

The present invention relates to air conditioning and dehumidification equipment, and more particularly to an air conditioning method and apparatus using desiccant wheel technology.

It is well known that traditional air conditioning designs are not well adapted to handle both the moisture load and the temperature loads of a building space. Typically, the major source of moisture load in a building space comes from the need to supply external make-up air to the space since that air usually has a higher moisture content than required in the building. In conventional air conditioning systems, the cooling capacity of the air conditioning unit therefore is sized to accommodate the latent (humidity) and sensible (temperature) conditions at peak temperature design conditions. When adequate cooling demand exists, appropriate dehumidification capacity is achieved. However, the humidity load on an enclosed space does not vary directly with the temperature load. That is, during morning and night times, the absolute humidity outdoors is nearly the same as during higher temperature midday periods. Thus, at those times there often is no need for cooling in the space and therefore no dehumidification takes place. Accordingly, preexisting air conditioning systems are poorly designed for those conditions. Those conditions, at times, lead to uncomfortable conditions within the building and can result in the formation of mold or the generation of other microbes within the building and its duct work, leading to what is known as Sick Building Syndrome. To overcome these problems, ASHRAE Draft Standard 62-1989 recommends the increased use of make-up air quantities and recommends limits to the relative humidity in the duct work. If that standard is properly followed, it actually leads to a need for even increased dehumidification capacity independent of cooling demands.

A number of solutions have been suggested to overcome this problem. One solution, known as an "Energy Recovery Ventilator (ERV)," utilizes a conventional desiccant coated enthalpy wheel to transfer heat and moisture from the make-up air stream to an exhaust air stream. These devices are effective in reducing moisture load, but require the presence of an exhaust air stream nearly equal in volume to the make-up air stream in order to function efficiently. ERVs are also only capable of reducing the load since the delivered air will always be at a higher absolute humidity in the summer months than the return air. Without active dehumidification in the building, the humidity in the space will rise as the moisture entering the system exceeds the moisture leaving in the exhaust stream. However, ERVs are relatively inexpensive to install and operate.

Other prior art systems use so-called cool/reheat devices in which the outside air is first cooled to a temperature corresponding to the desired building internal dew point. The air is then reheated to the desired temperature, most often using a natural gas heater. Occasionally, heat from a refrigerant condenser system is also used to reheat the cooled and dehumidified air stream. Such cool/reheat devices are relatively expensive and inefficient, because excess cooling of the air must be done, followed by wasteful heating of air in the summer months.

A third category of prior art device has also been suggested using desiccant cooling systems in which supply air from the atmosphere is first dehumidified using a desiccant wheel or the like and the air is then cooled using a heat exchanger. The heat from this air is typically transferred to a regeneration air stream and is used to provide a portion of the desiccant regeneration power requirements. The make-up air is delivered to the space directly, or alternatively is cooled either by direct or indirect evaporative means or through more traditional refrigerant-type air conditioning equipment. The desiccant wheel is regenerated with a second air stream which originates either from the enclosure being air conditioned or from the outside air. Typically, this second air stream is used to collect heat from the process air before its temperature is raised to high levels of between 150° F. to 350° F. as required to achieve the appropriate amount of dehumidification of the supply air stream. Desiccant cooling systems of this type can be designed to provide very close and independent control of humidity and temperature, but they are typically more expensive to install than traditional systems. Their advantage is that they rely on low cost sources of heat for the regeneration of the desiccant material.

U.S. Pat. Nos. 3,401,530 to Meckler, 5,551,245 to Carlton, and 5,761,923 to Maeda disclose other hybrid devices wherein air is first cooled via a refrigerant system and dried with a desiccant. However, in all of these disclosures high regeneration temperatures are required to adequately regenerate the desiccant. In order to achieve these high temperatures, dual refrigerant circuits are needed to increase or pump up the regeneration temperature to above 140° F. In the case of the Meckler patent, waste heat from an engine is used rather than condenser heat.

U.S. Pat. No. 4,180,985 to Northrup discloses a device wherein refrigerant condensing heat is used to regenerate a desiccant wheel or belt. In the Northrup system, the refrigerant circuit cools the air after it has been dried.

The invention as described in our parent application Ser. No. 08/795,818 is particularly suited to take outside air of humid conditions, such as are typical in the South and Southeastern portions of the United States and in Asian countries and render it to a space neutral condition. This condition is defined as ASHRAE comfort zone conditions and typically consists of conditions in the range of 73–78° F. and a moisture content of between 55–71 gr/lb. or about 50% relative humidity. In particular, the system is capable of taking air of between 85–95° F. and 130–145 gr/lb. of moisture and reducing it to the ASHRAE comfort zone conditions. However, that system also works above and below these conditions, e.g., at temperatures of 65–85° F. or 95° F. and above and moisture contents of 90–130 gr/lb. or 145–180 gr/lb.

As compared to conventional techniques the invention of the parent application has significant advantages over alternative techniques for producing air at indoor air comfort zone conditions from outside air. The most significant advantage being low energy consumption. That is, the energy required to treat the air with a desiccant assist is 25–45% less than that used in previously disclosed cooling technologies. That system uses a conventional refrigerant cooling system combined with a rotatable desiccant wheel. The refrigerant cooling system includes a conventional cooling coil, condensing coil and compressor. Means are provided for drawing a supply air stream, preferably an outdoor air stream over the cooling coil of the refrigerant system to reduce its humidity and temperature to a first predetermined temperature range. The thus cooled supply air stream is then passed through a segment of the rotary desiccant wheel to reduce its moisture content to a predetermined humidity level and increase its temperature to a second predetermined temperature range. Both the temperature and humidity ranges are within the comfort zone. This air is then delivered to the enclosure. The system also includes means for regenerating the desiccant wheel by passing a regeneration air stream, typically also from an outside air supply, over the condensing coil of the refrigerant system, thereby to increase its temperature to a third predetermined temperature range. The thus heated regeneration air is passed through another segment of the rotatable desiccant wheel to regenerate the wheel.

It is an object of the present invention to treat outside supply air at any ambient condition and render it to practically any drier and cooler psychrometric condition with lower enthalpy.

Yet another object of the present invention is to provide a desiccant based dehumidification and air conditioning system which is relatively inexpensive to manufacture and to operate.

Another object of the present invention is to heat make-up air while recovering enthalpy from a return air stream.

Yet another object of the present invention is to provide a desiccant based air conditioning and dehumidifying system using single, multiple and or variable compressors operating at the highest suction pressures possible to produce stable operating conditions and enhanced energy savings.

A further object of the present invention is to utilize the exhaust air from the building as a regeneration air source. This air will be at an absolute moisture condition substantially lower than ambient air for a portion of the year. Using this air and adding heat from the condenser coil will produce a better sink for process air moisture removal.

In accordance with an aspect of the present invention the system of the present invention includes an air conditioning or refrigeration circuit containing a condensing coil, a cooling or evaporation coil and a compressor and a desiccant wheel having a first segment receiving supply air from the cooling coil of the refrigeration circuit to selectively dry the supply air. A regeneration air path supplies regeneration air to a second segment of the desiccant wheel as it rotates through the regeneration air path. According to the invention this system is modulated to provide a constant outlet air condition from the process portion of the desiccant wheel over a wide range of inlet conditions and volumes. Preferably the system uses variable compressors whose output can be varied in response to air or refrigerant conditions at predetermined points in the system. In one embodiment the system may be operated in numerous different modes from fresh air supply only to supply of simultaneous cooled and dehumidified air. In addition a particularly simple and inexpensive housing structure for the system of the invention is provided.

The above, and other objects, features and advantages of the present invention will be apparent in the following detailed description of illustrative embodiments thereof, which is to be read in connection with the accompanying drawings, wherein.

Figure 1:
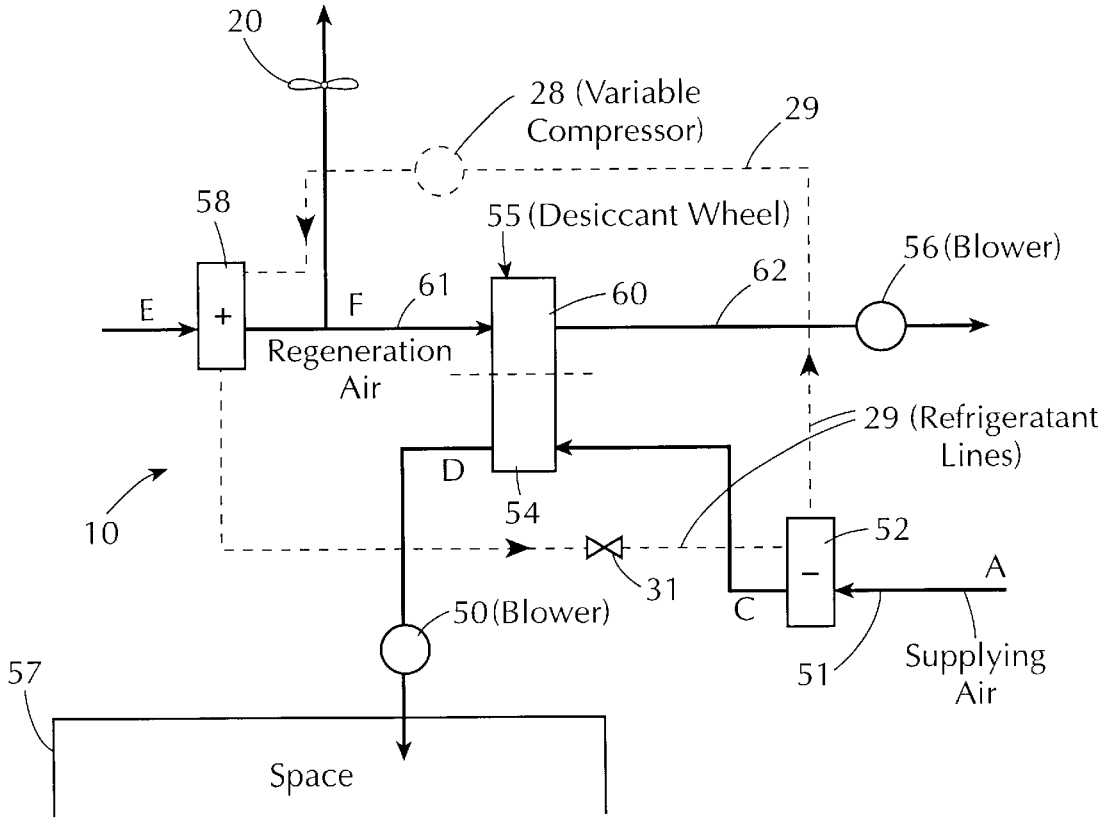
FIGS. 1, 1A and 1B are schematic diagrams of a first embodiment of the basic system of the present invention.

Referring now to the drawings in detail, and initially to FIG. 1 thereof, a simplified air conditioning and dehumidification system 10 according to the present invention is illustrated which utilizes a refrigerant cooling system and a rotating desiccant wheel dehumidification system. This system is a refinement of the system disclosed in our parent application. In this case the system takes air at any ambient condition and renders it to practically any drier and cooler psychrometric condition with a lower enthalpy.

In system 10, the refrigerant cooling system includes a refrigerant cooling circuit containing at least one cooling or evaporator coil 52, at least one condenser coil 58, and a compressor 28 for the liquid/gas refrigerant which is carried in connecting refrigerant lines 29. In use, supply air from the atmosphere is drawn by a blower 50, through duct work 51 or the like, over the cooling coil 52 of the refrigerant system where its temperature is lowered and it is slightly dehumidified. From there, the air passes through the process sector 54 of a rotating desiccant wheel 55 where its temperature is increased and it is further dehumidified. That air is then provided to the enclosure or space 57.

Desiccant wheel 55 of the dehumidification system is of known construction and receives regeneration air in a regeneration segment 60 from ducts 61 and discharges the same through duct 62. The wheel 55 is regenerated by utilizing outside air drawn by a blower 56 over the condenser coil 58 of the air conditioning system. This outside air stream is heated as it passes over the condenser coil and is then supplied to regeneration segment 60 to regenerate the desiccant. The regeneration air is drawn into the system and exhausted to the atmosphere by the blower 56.

In this embodiment, compressor 28 is a variable capacity compressor and preferably an infinitely adjustable screw type compressor with a slide valve. As is understood in the art the volume through the screws in such a compressor is varied by adjusting the slide valve and thus the volume of gas entering the screw is varied. This varies the compressor's output capacity. Alternatively a time proportioned scroll compressor, a variable speed scroll or piston type compressor may be used to circulate the refrigerant in line 29 through a closed system including an expansion device 31 between the condenser coil 58 and the evaporator or cooling coil 52.

It has been found that by using a single non variable compressor in refrigeration systems, the compressor does more work than needs to be done with the results that the desired set point of the system may be over shot. By using variable compressors as described the system can modulate to provide a constant outlet condition over a range of inlet air conditions and volumes. That is, the operation of the compressor is controlled in response to one or more conditions. As a result, for example, one can maintain a desired usable and selectable humidity condition leaving the desiccant wheel by modulating the compressor capacity.

Such modulation can be achieved by using more than one compressor or variable compressors, such as the time proportional compressor offered by Copeland, or variable frequency compressors which use synchronous motors whose speed may be varied by varying the hertz input to the motor, which causes variation in work output.

The refrigeration system described above can be modulated or controlled to provide a constant outlet condition over a range of inlet conditions and volumes. It allows the system to be used in make-up air applications to meet requirements for ventilation, pressurization or air quality (e.g., in restaurants where make-up air is required to replace kitchen exhaust air). Thus control of the delivered make-up air volume can be made dependent on pressure (through use of pressure sensors for clean rooms and the like), $CO_2$ content (through use $CO_2$ sensors) to control quality, or based on occupancy (using room temperature sensors). Such sensors would control make-up air volume using known techniques to control, for example, the speed of blower 50 or air diverter valves (not shown) in duct 51. The system, using the variable compressor, can still be modulated to accommodate the variation of temperature or humidity caused by the addition of make-up air in order to maintain the desired environmental conditions.

Figure 2:
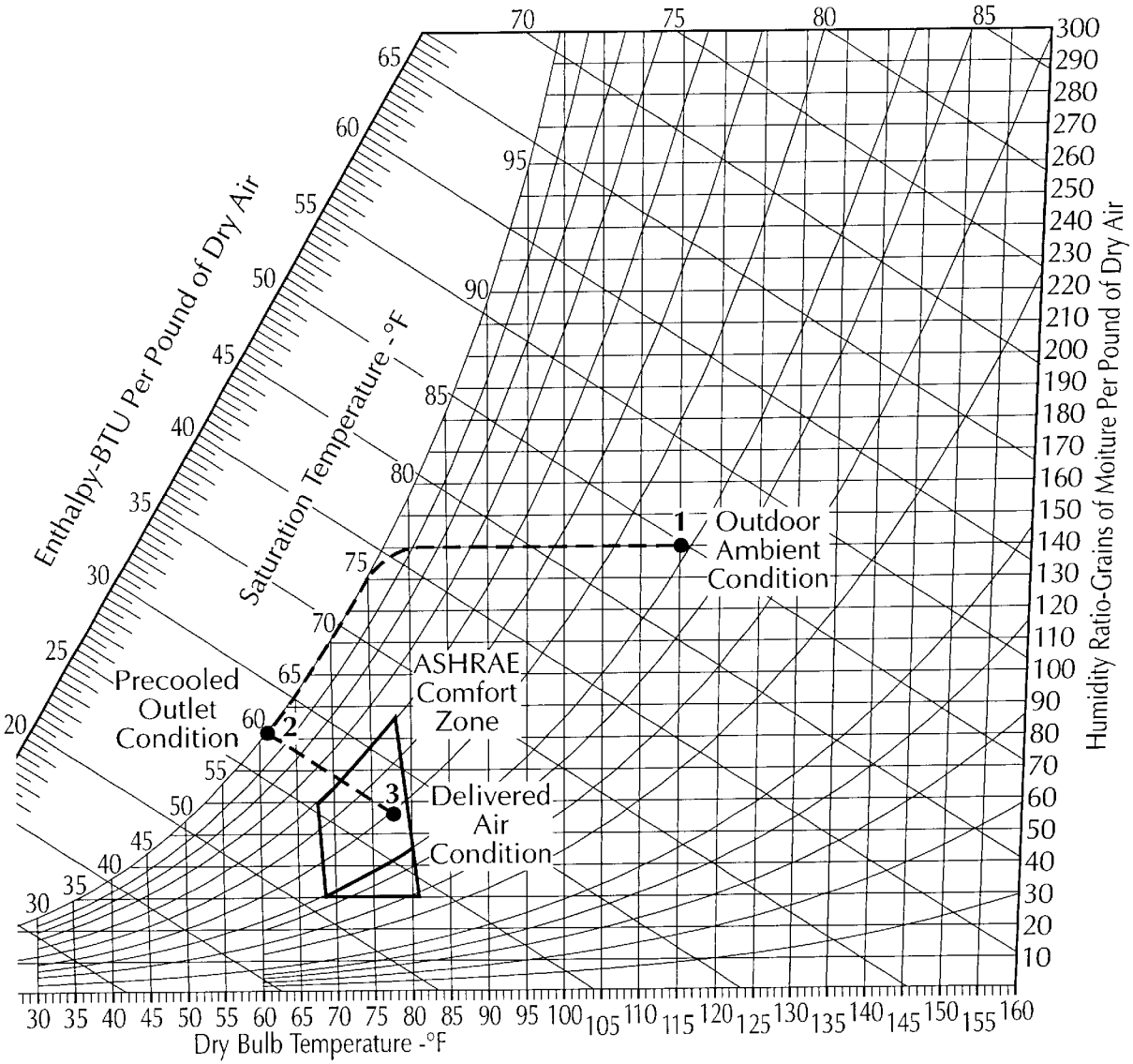
FIG. 2 is a psychrometric chart describing the cycle achieved by the embodiment of FIG. 1.

According to this invention a desired delivered air temperature and humidity level for the supply air to the enclosure or space 57 can be maintained within the ASHRAE comfort zone discussed above. From those temperatures and humidity conditions the corresponding wet bulb temperature can be determined, establishing the desired conditions represented at Point 3 on the psychrometric chart of FIG. 2. This wet bulb temperature is used as the target set point for the cooling and drying of the supply air (whether it is return air alone or mixed with make-up air as described above). Utilizing the variable capacity of the compressor 28, the capacity of the cooling coil 52 is controlled to maintain the supply air temperature leaving the coiling coil at a temperature which will allow the conditioning of Point 3 to be attained after the air passes through the process segment 54 of the desiccant wheel. This temperature will be slightly lower than the calculated wet bulb temperature of the desired delivered air. Thus, as shown in FIG. 2, supply air (in this case ambient air as shown in FIG. 1) which will typically have a temperature range of between 65° and 95° F. DBT and above and a moisture content of between 90–180 grains/lb. enters the cooling coil 52 at 95° F. Dry Bulb Temperature ("DBT"), 78.5° F. Web Bulb Temperature ("WBT") and a moisture content of 120 grains/lb. (Point 1 on FIG. 2). As the air passes through coil 52 its conditions move along the dotted line in FIG. 2 from Point 1 at relatively constant humidity until it reaches saturation and its humidity is then reduced with temperature along the saturation line to Point 2 where it leaves the coil in a saturated condition of between 50°–68° DBT and 30–88 grains/lb. moisture content, in this case at 61° DBT and 80.4 grains/lb. The air then enters the process segment 54 of the desiccant wheel. As it passes through the wheel the air is dried and heated adiabatically, following the approximate path of the wet bulb line. It is further dried to its leaving condition of between 68–81° F. DBT, 50–65° F. WBT, and 30–88 grains/lb. moisture content, in this case at Point 3 of 77° F. DBT, 61.5° WBT and 57 grains/lb. Of course it is understood that the compressor is operated in response to the temperature of the air leaving the cooling coil at Point C in FIG. 1 to achieve the desired final air temperature.

The length of travel down the line from Point 2 to Point 3 depends on the regeneration conditions of wheel 55. In accordance with this invention the regeneration air temperature is increased to provide a longer path down the wet bulb line, i.e., more drying, and reduced to provide less movement, i.e., less drying. In this manner the appropriate drying of the wheel also can be achieved so that the supply air leaving condition (Point 3) will equal the intended design condition.

As will be understood, given the capacity demanded from the cooling side set point, the condensing coil 58 will need to eject varying amounts of heat to the ambient air stream entering that coil depending on conditions at Point E (FIG. 1). The variable heat flux entering at Point E would, under normal conditions, result in an uncontrolled regeneration temperature F entering the wheel 55. According to the present invention the volume of air flow through coil 58 is varied by the use of a bypass or exhaust fan 70 in order to achieve the appropriate regeneration temperature entering wheel 55. This is done by sensing the temperature of air entering the wheel and controlling the fan 70 to selectively increase or decrease the volume of air drawn through coil 58 with blower 56 in order to control the temperature of air entering the wheel. Any unnecessary volume of air is then dumped to the atmosphere by fan 70. Airflow is increased to reduce the temperature and reduced to increase the temperature. The remaining air is then drawn through the desiccant wheel to provide the appropriate desiccant dryness required to achieve the desired drying results, i.e., the movement from Point 2 to Point 3 in FIG. 7. By dumping excess air passing coil 58 when the air quantity required to maintain the desired regeneration temperature exceeds the air flow needed to regenerate the desiccant total, energy is conserved by not exposing the incremental air flow to the pressure drop associated with the desiccant wheel. It also means a smaller blower 56 may be used.

This system allows compressor 28 to operate at the highest suction pressure necessary to obtain the leaving air condition, i.e., the temperature of air leaving the wheel 55. When this is done the compressor operates against the minimum pressure ratio possible to produce the intended result. Thus the performance of the cycle is maximized, reducing energy consumption.

Figure 1A:
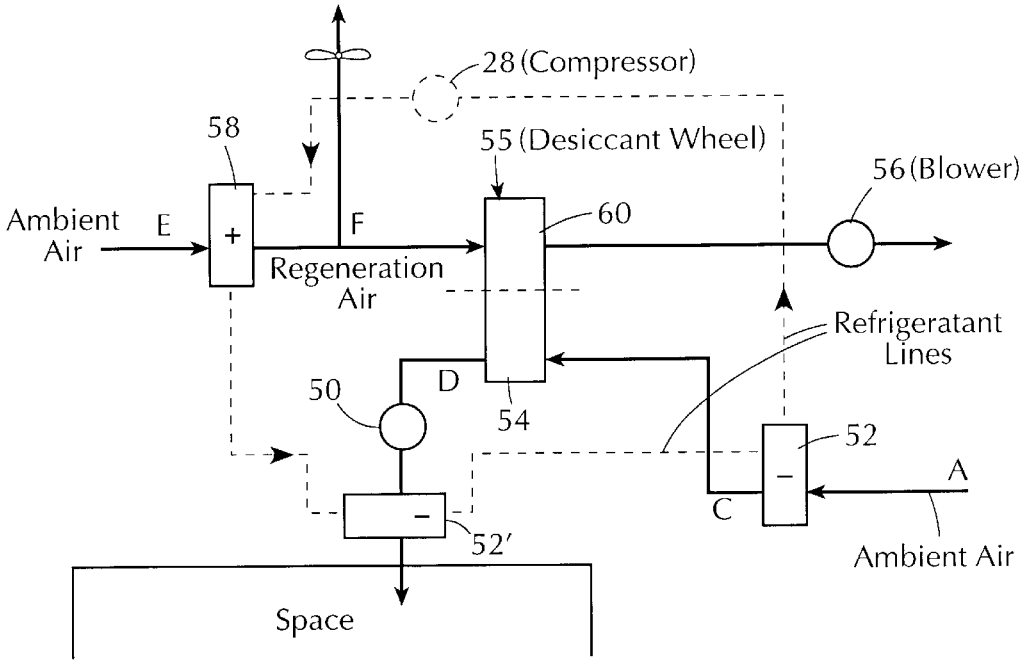
Figure 1B:
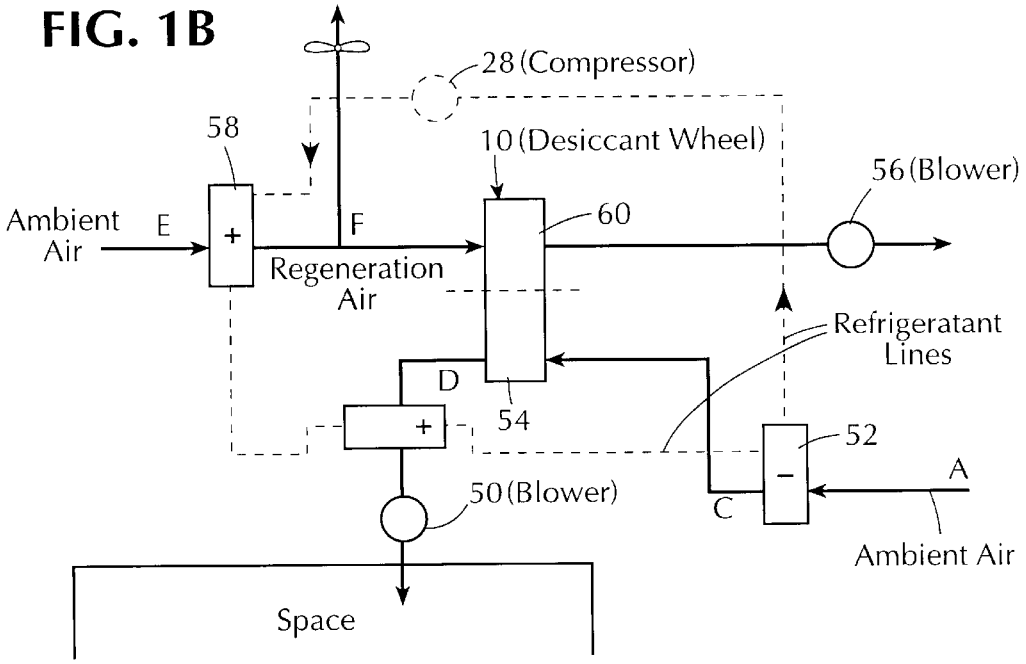

When it is required to obtain additional sensible cooling a secondary cooling coil 52' may be used to further cool air leaving the desiccant wheel. This coil may be supplied with refrigerant from the same compressor 28. As shown in FIGS. 1A and 1B this additional coil 52' can be placed on either side of blower 50. In the position shown in FIG. 1A, coil 52' allows for reduction in the supply air temperatures after a slight rise in the air temperature occurring from its passage through blower 50. In the position shown in FIG. 1B, coil 52' is upstream of blower 50 in the case where the temperature increase from the blower is immaterial. Since the cooling coil performs more efficiently on the suction side of a fan this is the preferred embodiment where added blower heat is not a factor.

Figure 3:
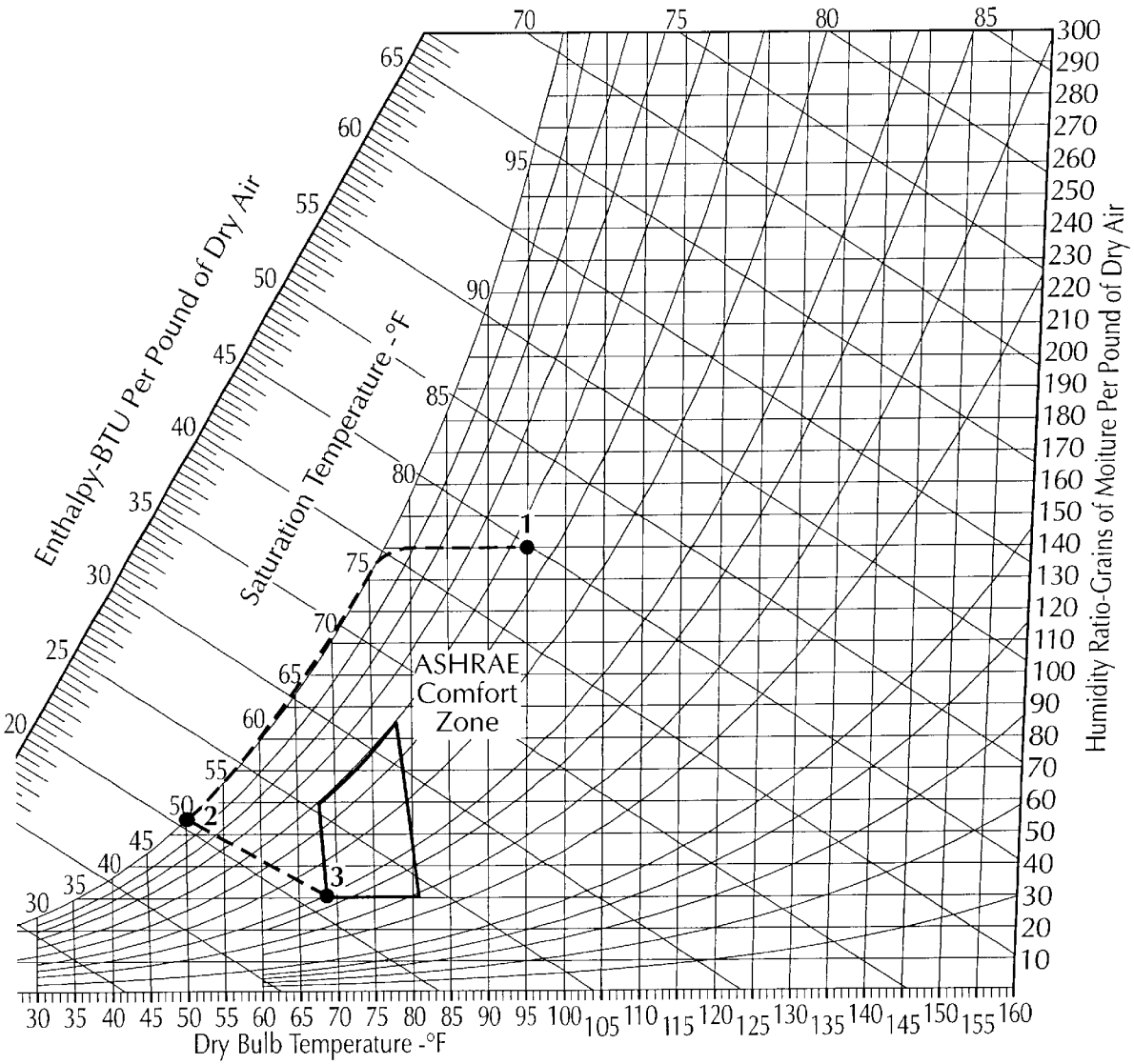
FIG. 3 is a psychrometric chart describing the cycle achieved by the embodiment of FIG. 1 using a different control system.

As an alternative to the control system described above, control also can be achieved without the calculation of wet bulb temperature by controlling the capacity of the cooling side of the device to provide the desired cooling capacity for the space, i.e., controlling the compressor using the desired space temperature and allowing the condensing side of the system to modulate accordingly. In this case the volume of air drawn through the condenser 58 is controlled to achieve the required regeneration temperature, within limits of acceptable condensing pressure, and thus also achieve the required regeneration capacity. The regeneration temperature is increased to reduce outlet humidity ratio, and decreased to reduce drying capacity, within acceptable pressure limits. This system is shown in FIG. 3, wherein ambient air at Point 1, 95° F. DBT 78.5° F. WBT, 120 grains/lb. enters the cooling coil. It follows the dotted line to the saturated curve as it passes the cooling coil to Point 2 at 50° F. saturated and 64.6° grains/lb. This air then enters the process segment 54 of the desiccant wheel. As the air passes through the wheel it dries and is heated adiabatically following the approximate path of the wet bulb line to Point 3 which is its leaving condition at 69° F. DBT; 52° F. WBT, 30 grams/lb. The combined effect of minimizing and controlling the precooled temperature and regeneration temperatures as described above achieves the target leaving conditions within the ASHRAE comfort zone.

The length of travel down the wet bulb line depends on the regeneration condition. As noted above the regeneration temperature is increased to provide a longer path down the line, or more drying, and is reduced in order to produce less drying. In the alterative control system first described the sensible cooling capacity is increased allowing the equipment to provide cooling of the space.

Figure 13:
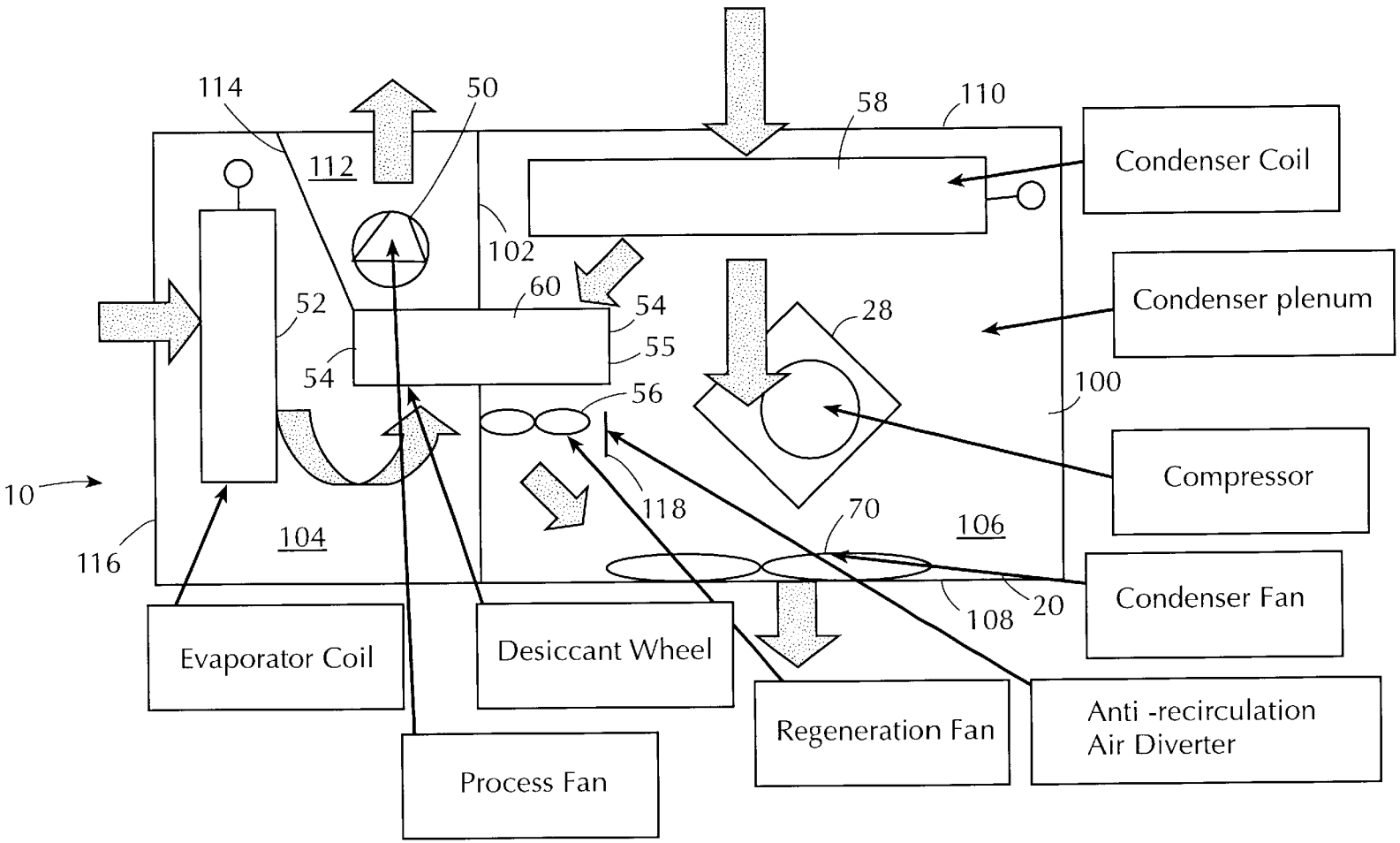
FIG. 13 is a schematic plan view of a housing structure for use with the system of FIG. 1.

FIG. 13 shows a schematic plan view of an air conditioning/dehumidifying unit 10 according to FIG. 1 wherein the components bear the same reference numerals. As seen therein the unit 10 is contained in a housing 100 in an arrangement which eliminates the need for the duct work 51, 61 described above. Housing 10 is a rectangular box like structure which defines an internal plenum 100 that is divided by an internal wall 102 into plenum sections 104, 106. The desiccant wheel is rotatably mounted in wall 102 so that its process segment or sector 54 is located in plenum 104 and its regeneration segment 60 is in plenum 106. Blower 70 is located at one side 108 of plenum 106 to draw supply air through apertures (not shown) in the opposite side 110 over and through coil 58. That air flows over the compressor 28 to cool that as well and is discharged through apertures in wall 108 to the atmosphere.

Blower 50 is located in plenum 104 near the process segment of wheel 55 in a sub plenum 112 defined by a wall 114 in plenum 104. Blower 50 draws supply air through openings (not shown) in end wall 116 over and through evaporator coil 52 and then through the process segment 54 into plenum 112. From there the supply air is discharged through openings (not shown) in wall 110 at sub plenum 112 to the enclosure of separate duct work leading to the enclosure 57.

Blower 56 is mounted in plenum 106 adjacent the downstream side of the regeneration segment 54 of the desiccant wheel. A baffle or other separating or channel means 118 is positioned in plenum 106 adjacent wheel 55 and extends part way towards wall 108. As described above, blower 56 draws some of the air leaving coil 58 through the regeneration segment 60 of the desiccant wheel to regenerate the wheel. The baffle 118 prevents recirculation of air leaving the wheel from recirculating back around the wheel. That air then either mixes with air being expelled from the plenum by fan 70 to the atmosphere or it may be separately ducted, in whole or in part, to the supply air line.

This structure has numerous advantages including its compact size, elimination of duct work, and reduction in condenser and regeneration fan/blower horsepower. It also eliminates the use for any anti-back draft louvers on the condenser circuit.

Figure 4:
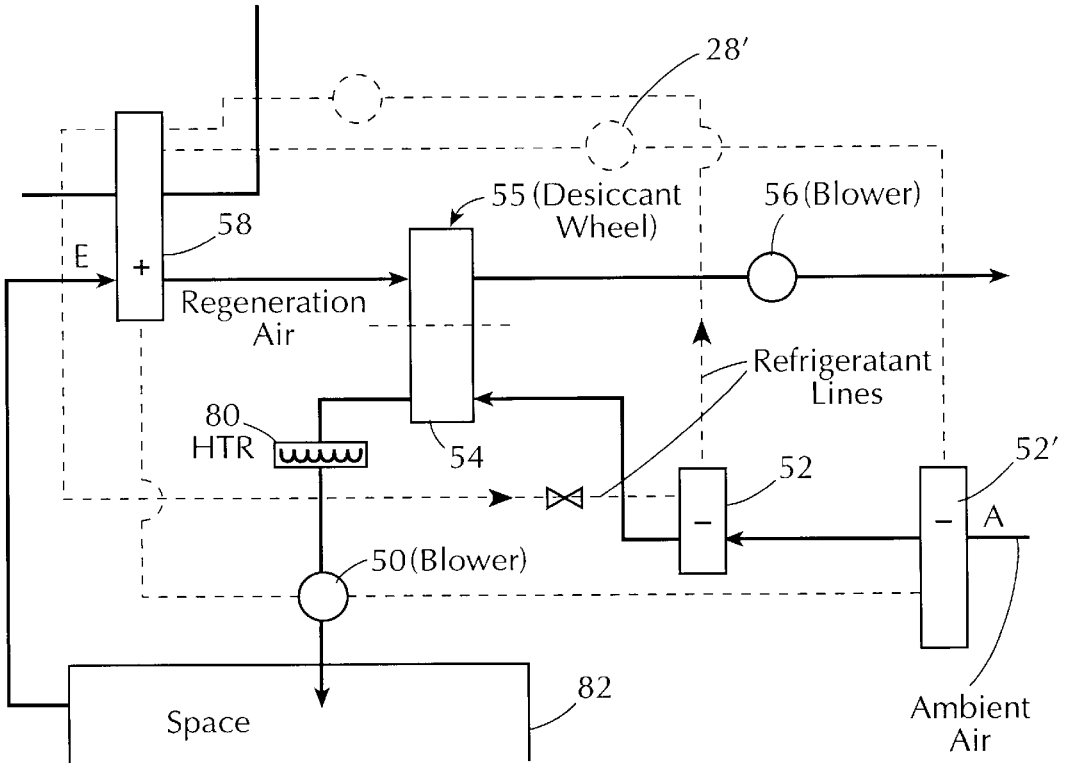
FIG. 4 is a schematic view of another embodiment of the present invention which is adapted to treat make-up air and recover enthalpy from the return air stream.

Another embodiment of the invention is illustrated in FIG. 4. In this embodiment the system is adapted to treat make-up air and recover enthalpy from a return air stream. Return air is often available in applications where fresh air is provided due to high space make-up air requirements resulting from occupant capacity, and where a large amount of air is not required for space pressurization for infiltration load minimization. This type of design is typically used for schools, theaters, arenas and other commercial spaces where humidity need not be controlled to below normal level (such as is required in supermarkets and ice rinks, which see energy and quality benefits from lower humidity conditions.) Moreover such large spaces use large volumes of air which have substantial heat value in them.

The system 80 of this embodiment comprises a cooling coil 52 for treatment of an outdoor ambient supply air stream A followed by a desiccant wheel 55 and blower 50 for conveying the supply air stream to the space or enclosures. This air stream constitutes the make-up air. The evaporator or cooling coil 52 is connected to a plurality of DX refrigerant compressor circuits. This is illustrated in FIG. 4 as two coils 52, 52' and their associated compressors 28 and 28'. However it is to be understood that the cooling circuit containing coil 52 and compressor 28 may consist of more than two separately operable circuits containing separate coils and compressors.

A second or regeneration air stream E is drawn from the space 82 and is of a quantity approximately equal to 50 to 100% of the make-up air in the first air stream A. This air first flows through the condensing coil 58, then through the regeneration segment of desiccant wheel 55, and is ejected from the enclosure to ambient. The refrigeration circuit for this system is designed such that the required heat rejected (i.e., given up) in the condenser to the air stream does not exceed the heat carrying capacity of the second air stream between its return air temperature and the maximum refrigeration circuit condensing temperature of approximately 130° F. The refrigerant from this coil 58 is then used to cool the first (supply) air stream.

As also seen in FIG. 4 one or more additional compressors are connected to the cooling coil of the supply air stream. These are sized to provide the additional cooling capacity to take the ambient make-up air stream from ambient conditions down to 57°–63° F. These additional cooling circuits possess their own condensing circuits that eject their heat directly to ambient. This is shown in FIG. 4 at condenser 58' which treats ambient air drawn through it by fan 70.

In this embodiment, desiccant wheel 55 is equipped with a drive motor arrangement that enables the desiccant wheel to rotate selectively at high revolutions, namely 10–30 rpm, and at low revolutions, namely 4–30 rph. In the high speed mode the desiccant rotor will act as an enthalpy exchanger and will transfer latent and sensible heat between the regeneration and make-up air stream. In the winter an enthalpy wheel heats and humidifies the make-up air, and in the summer it will cool and dehumidify.

The system of this embodiment can operate in five different modes. As described hereinafter, the compressors and wheel speed states are changed to adapt the performance of the system to the space requirements. The system can run in any or a combination of the five modes. The main five modes are: Cooling only mode; Dehumidification only mode; Cooling and dehumidification mode; Enthalpy exchange mode; and Fresh air mode.

Figure 5:
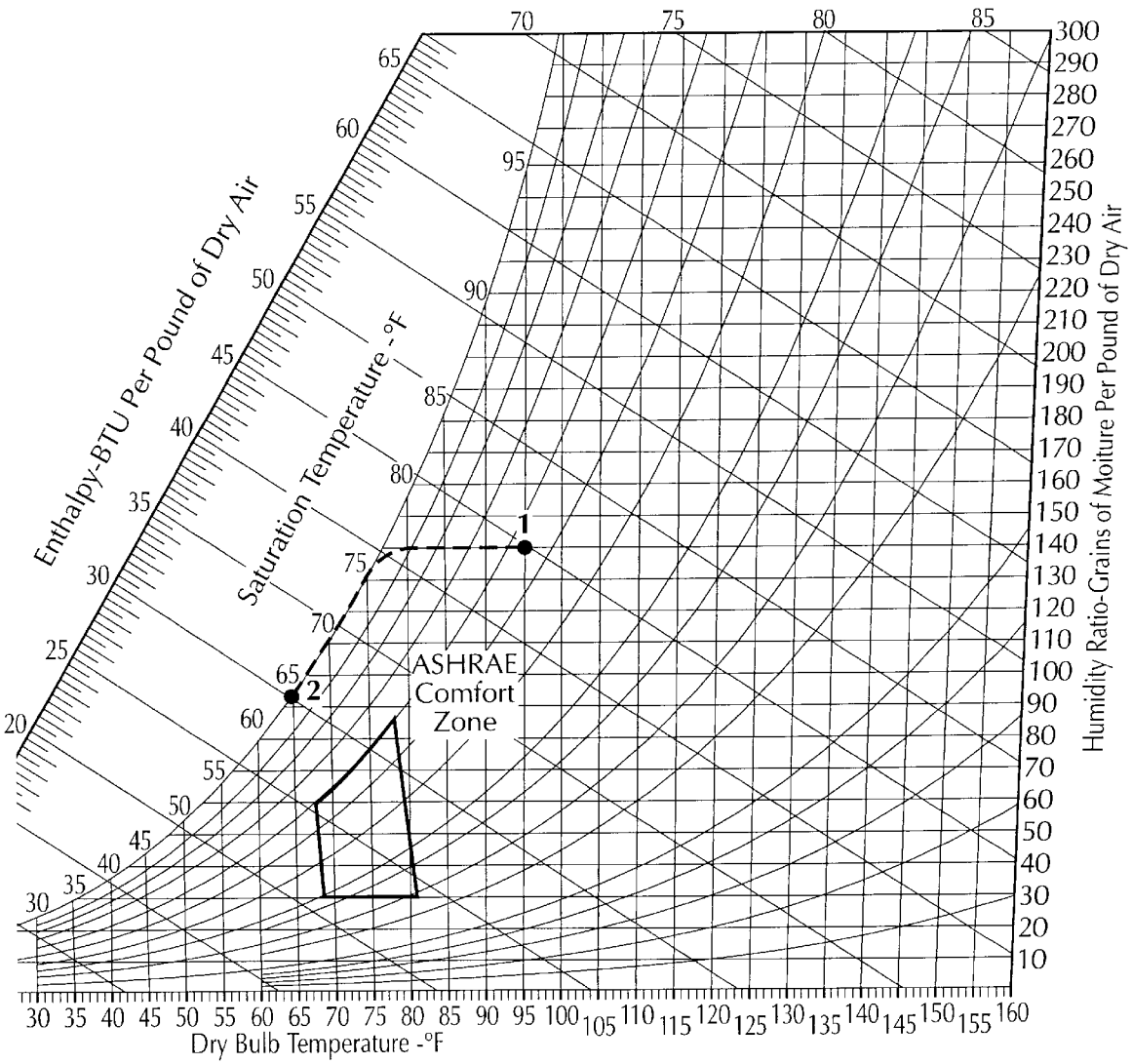
FIG. 5 is a psychrometric chart showing the cycle achieved with the system of FIG. 4 in the cooling only mode.

Operation of this system in the cooling only mode is illustrated on the psychrometric chart of FIG. 5. In this mode desiccant wheel 55 is not operated and only the number of compressors necessary to provide sufficient cooling to the space are operating. However the compressor 28' whose condenser coil 58 is in the return air line is not operating since the wheel is not operating. Operating in this manner, as seen in FIG. 5, ambient air in air stream A enters the bank of cooling coils at the conditions of Point 1, at 95° F. DBT, 78.5° F. WBT, and 120 grains/lb. moisture content. As it passes through the cooling/evaporator coils it moves along the dotted line to and then down the saturation curve to Point 2 at 65° F. saturated, 92.8 grains/lb. The air has been cooled and dehumidified at this point, but not necessarily to the ASHRAE comfort zone since no dehumidification from the wheel occurs. Heat absorbed in the condensing coil 58' is simply rejected to the ambient air stream via the condenser and fan 70.

Figure 6:
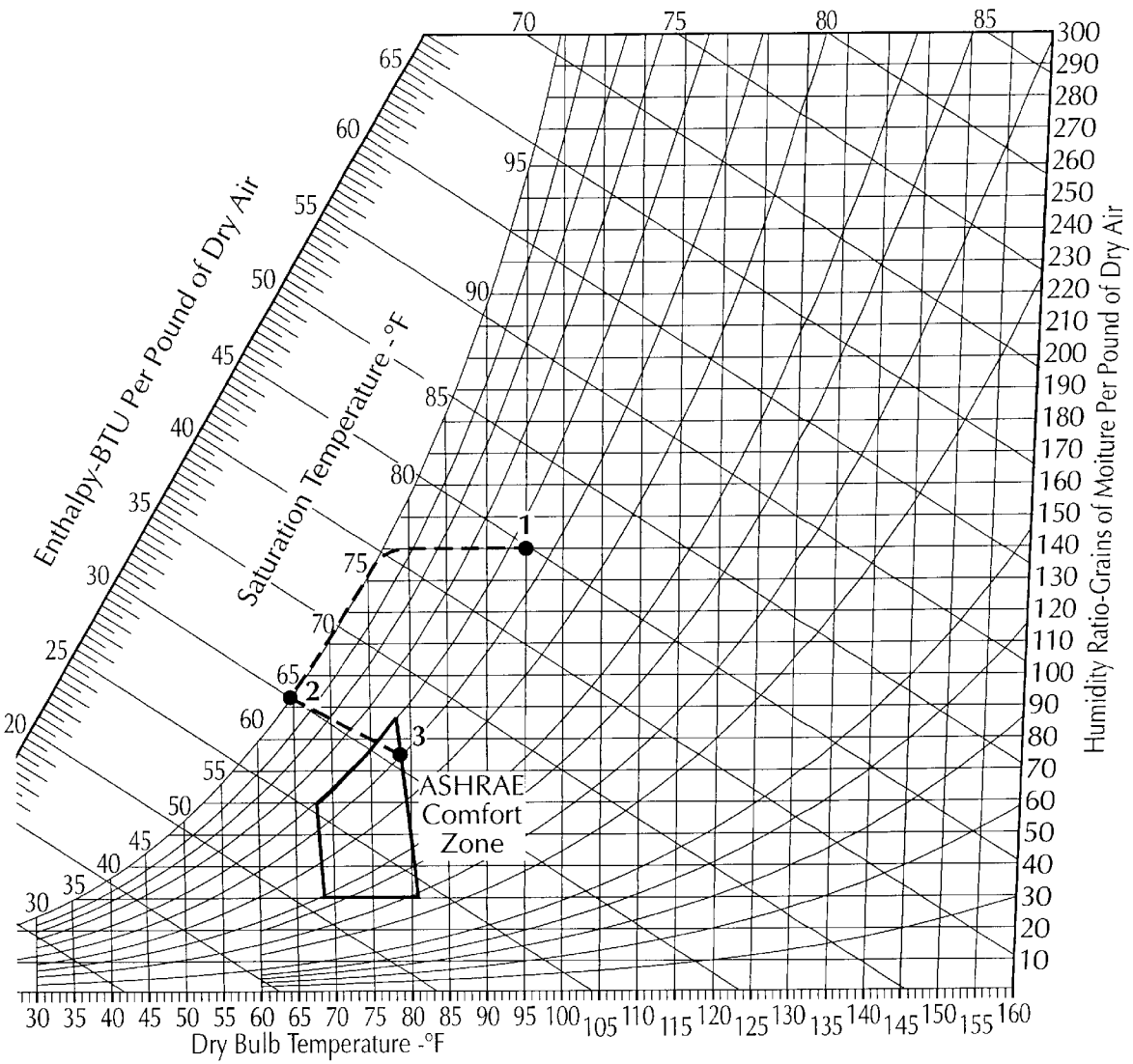
FIG. 6 is a psychrometric chart showing the cycle achieved with the system of FIG. 4 in the dehumidification only mode.

Operation of the system of FIG. 4 in the dehumidification only mode is shown in the psychrometric chart of FIG. 6. In this mode the desiccant motor is operated at low speed mode (i.e., 4–30 rph) and the compressor 28' which serves the condensing coil 58 in the return air stream E is operating to heat the regeneration air. The other refrigeration circuits, including compressors 28 and coils 58', 52 are not operating. Thus, as seen in FIG. 6, ambient air A enters the bank of evaporation coils at the conditions of Point 1, at 95° F. DBT, 78.5° F. WBT, and 120 grain/lb. As this air passes coil 52, 52' it is cooled in coil 52' along the dotted line on the chart to and down the saturation line to Point 2 at 65° F. saturated, 92.8 grains/lb. Because the desiccant wheel is operating, air stream A is processed in the wheel where it is dried and heated adiabatically following the approximate path of the wet bulb line. It leaves the desiccant wheel and is supplied to enclosure 82 at the conditions of Point 3, at 79° F. DBT, 66° F. WBT and 75 grains/lb.

In this example and in typical operation the regeneration air taken from the space 82 by blower 56 will be at conditions of about 80° F. DBT an 67° F. WBT, approximately the same condition as the supply air stream of ambient air. This regeneration air (i.e., the exhaust air from the space) is passed through condenser coil 58, receives heat rejected from that coil and then flows through wheel 55 to regenerate it. This is a substantial advantage, in this condition of operation, over the use of ambient air alone to regenerate the wheel since the exhaust air leaving the condenser coil will have lower relative humidity than if ambient air was used. Thus it will absorb more moisture from the wheel and improve desiccant performance over what is achievable with outside air alone. After passing the wheel it is vented to the atmosphere.

Figure 7:
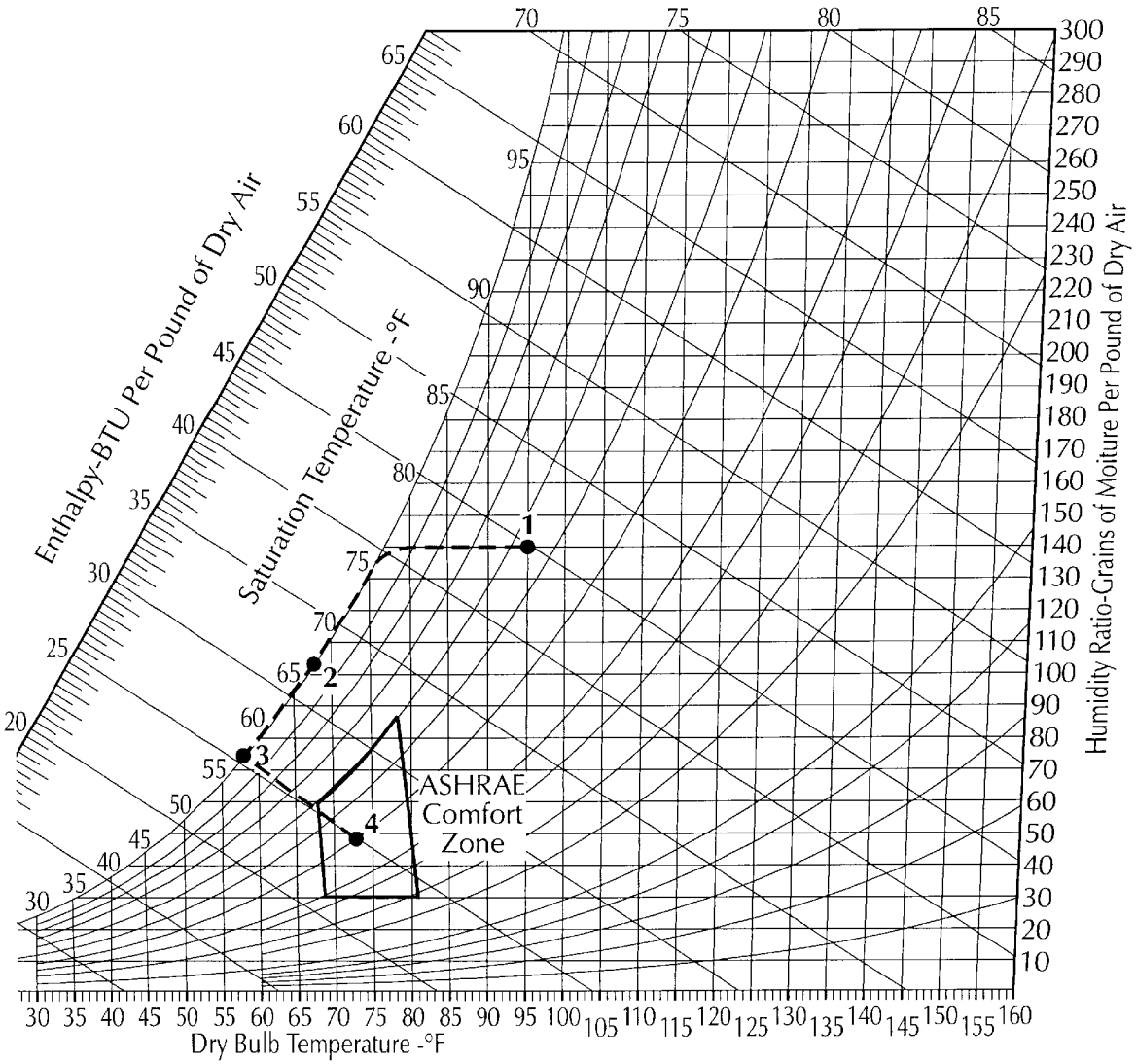
FIG. 7 is a psychrometric chart showing the cycle achieved with the system of FIG. 4 in the dehumidification and cooling mode.

Operation of the system of FIG. 4 in the cooling and dehumidification mode is illustrated on the psychrometric chart of FIG. 7. In this mode, as in the dehumidification only mode, desiccant wheel 55 is rotated slowly (4–30 rph) but additional cooling is provided by the additional cooling circuit or circuits containing coils 58', 52 and compressor 28 which are operated, as they do in the cooling only mode. In this case the cooling and dehumidification modes work together. The first stage of refrigeration circuit containing coil 58, 52' and compressor 28' also operate and provide the reactivation energy source.

Operating in this manner, supply air A (either all ambient or a mixture of ambient and some return air) enters the bank of cooling coils at Point 1 (FIG. 7) at 95° F. DBT, 78.5° F. WBT, 120 grains/lb. It again follows the dotted line and down the saturation line to Point 2, exiting coil 52'. Because the second or additional stages of cooling circuits are operating the condition of that air continues further down the saturation line arriving at Point 3 after exiting the secondary cooling stage 52. At that point the supply air stream conditions are 57° F. saturated, 69.5 grains/lb.rh. This air then enters the process segment 54 of the desiccant wheel 55 where it is dried and adiabatically heated. It follows generally the path of the wet bulb line and leaves the wheel at Point 4 at 74° F. DBT, 58° F. WBT, and 48 grains/lb.

Figure 8:
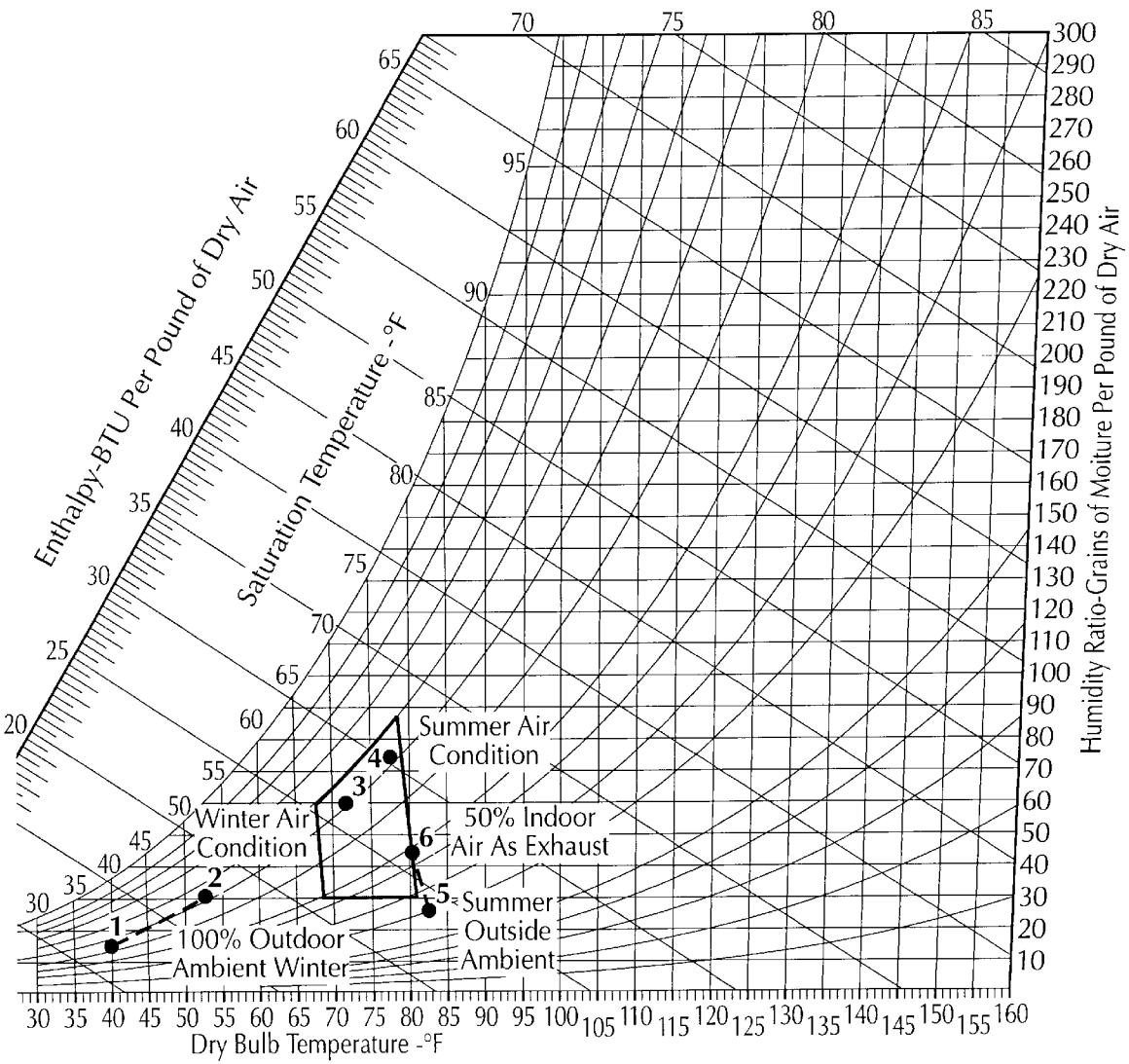
FIG. 8 is a psychrometric chart showing the cycle achieved with the system of FIG. 4 in an enthalpy exchange mode.

Operation of the system of FIG. 4 in the enthalpy exchange mode is illustrated in the psychrometric chart of FIG. 8. This mode is typically used in summer when the outside air is at a higher enthalpy than the indoor air, or in winter when indoor enthalpy exceeds outdoor enthalpy.

In this case the desiccant wheel 55 is driven at high speed (10–30 rpm) and all the refrigeration circuits are off. As shown in FIG. 8, in winter, when 100% outside air is used having the conditions at Point 1 of 40° F. DBT, 32° F. WBT and 12.6 grains/lb. passage of the air through the process section 54 of the wheel will cause the conditions of the air exiting the wheel to move along the dotted line from Point 1 to Point 2 at 52.5° F. DBT, 44.5° F. WBT, and 30.5 grains/lb. From that point a conventional heater 80 can heat the air to the desired room temperature. The exhaust air drawn from the heater is supplied to section 60 to transfer heat and moisture thereto.

In the summer condition using 100% outside air at Point 5, 82.5° F. DBT, 56° F. WBT and 42 grains/lb. the system will operate in a reverse manner by causing the air to move along the dotted line from Point 5 to Point 6, i.e., to 80° F. DBT,61.5° F. WBT, 42 grains/lb., just at the ASHRAE comfort zone.

Using the system of FIG. 4 in its enthalpy exchange mode with 50% ambient air and 50% return air will cause the air conditioning entering the desiccant wheel process section 54 to move from Point 3 to Point 4 on FIG. 8.

Figure 9:
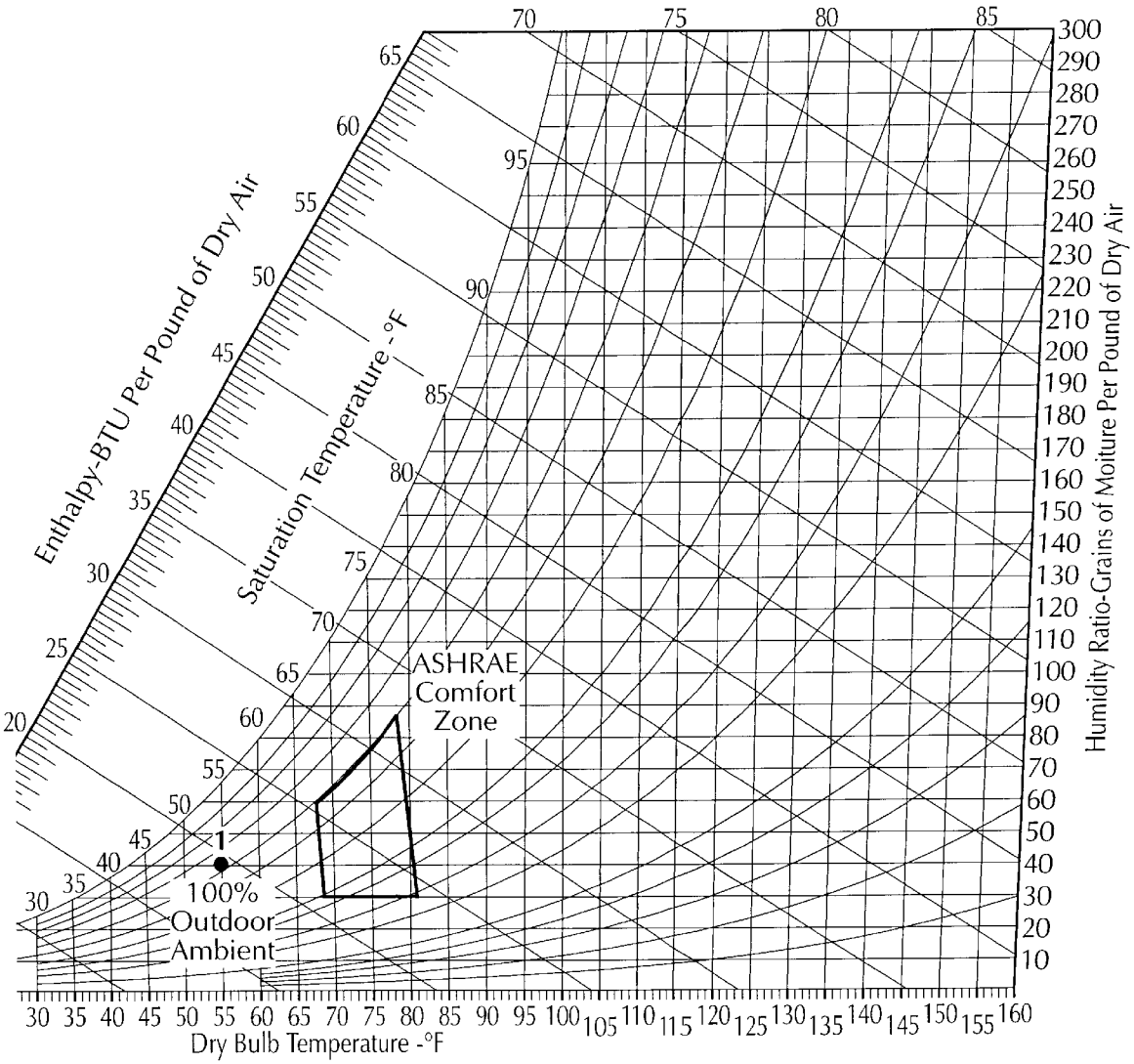
FIG. 9 is a psychrometric chart showing the cycle achieved with the system of FIG. 4 in a fresh air exchange mode.

The final, fresh air exchange mode of operation of the embodiment of FIG. 4 is shown on the psychrometric chart of FIG. 9. In this case all cooling circuits and the desiccant wheel are off, and only the blowers are on to constantly replenish fresh air. As a result the system delivers fresh ambient air without heat recovery, cooling or dehumidification.

Preferably the compressors used in this embodiment are also of the variable type to provide more efficient operations.

Figure 10:
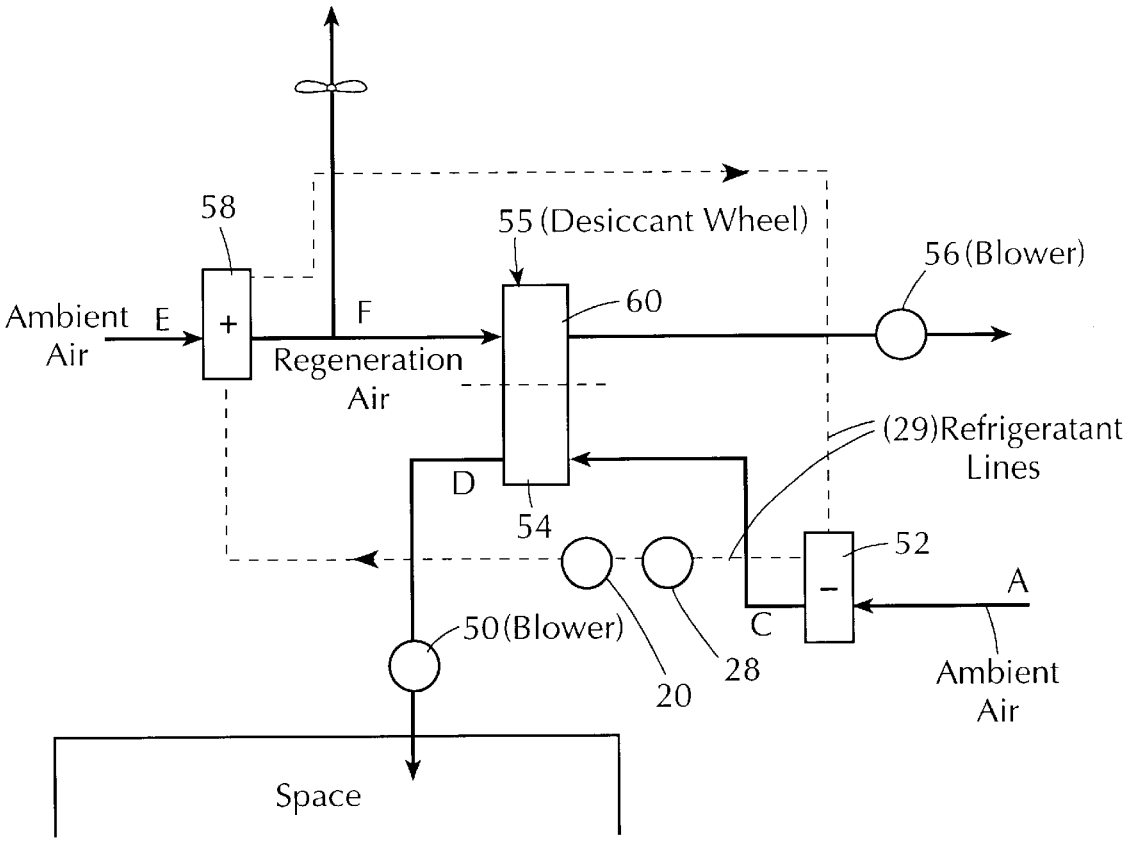
FIG. 10 is a schematic diagram of an embodiment similar to that of FIG. 1, but utilizing two compressors.

Yet another embodiment of the present invention is illustrated in FIG. 10. The system of this embodiment is similar to that of FIG. 1, except that two compressors 28 are used in the refrigeration circuit. As seen in the evaporator cross plot of FIG. 11 for a representative two compressor cooling circuit two operating conditions for the system are possible depending upon whether one or both compressors are operating. To minimize energy use, by increasing the coefficient of performance (COP) of the system it is desirable to operate the system at the highest suction pressures possible which permits the desired space humidity and temperature conditions to be achieved. Operating one compressor instead of two wherever possible also conserves energy.

FIG. 8 shows two sloping lines rising to the right showing the capacity in BTUH of one and two compressors versus saturated suction temperature with the compressors operating at 100% capacity for that temperature. The term saturated suction temperature means the temperature of the coolant gas leaving the evaporator cooling coil 52 and entering the compressors.

Figure 11:
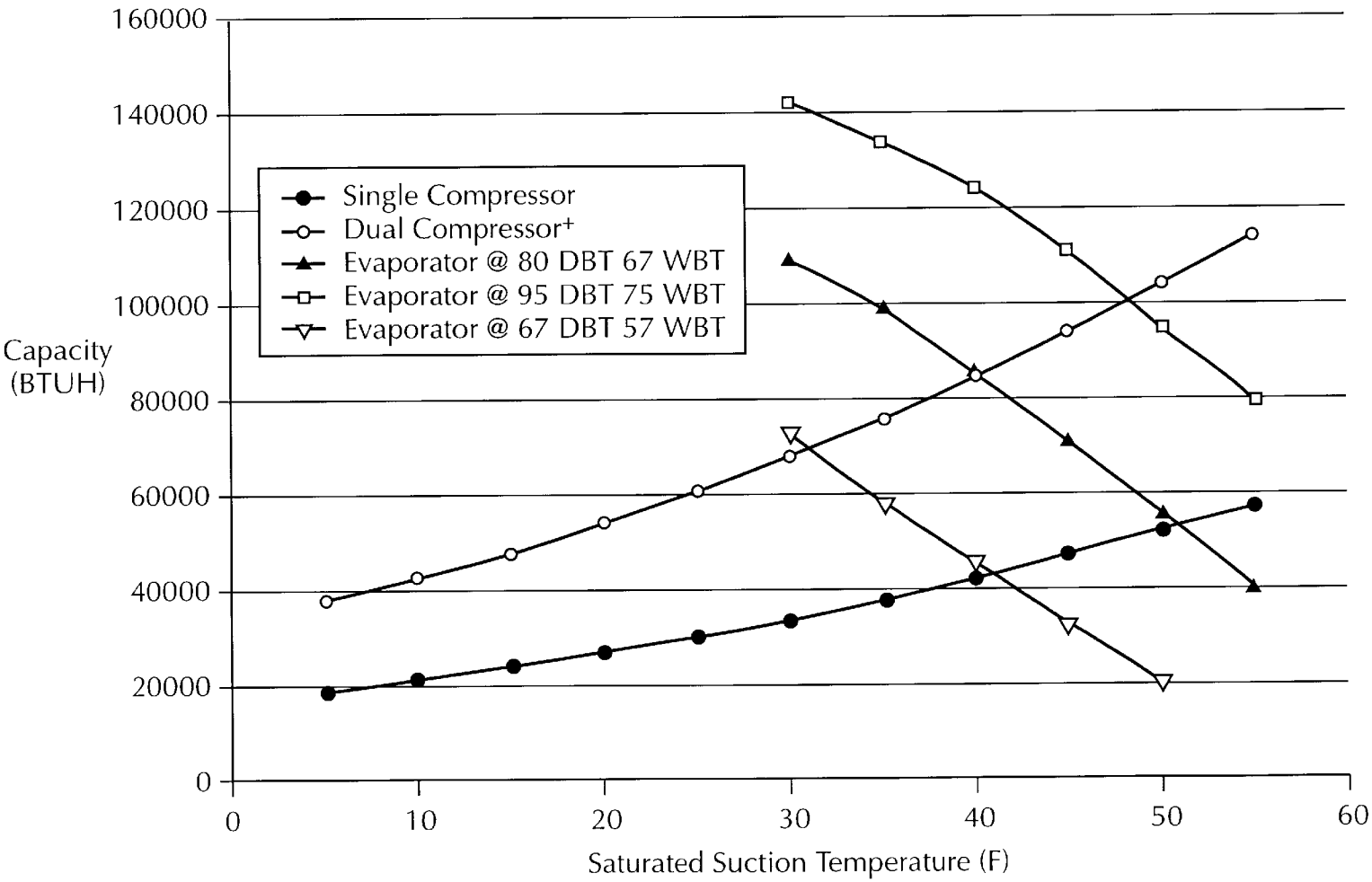
FIG. 11 is an evaporator cross plot for the system of FIG. 10.

The three lines which slope upwardly and to the left in FIG. 11 represent the suction temperature of the refrigerant gas when the supply air stream is at one of three conditions noted on the graph and shows the corresponding capacity of the compressors at each temperature. Where the two sets of sloping lines cross, the evaporator and compressor are operating at the same conditions and therefore the most efficiency.

Typically multiple compressors (as well as variable compressors) have been operated to cut in and out of operation based on either fixed pressure points detected in the refrigerant line or based on the temperature of the supply air leaving the evaporator/cooling coil. In the present invention, using a humidity control unit (i.e., desiccant wheel), the space humidity error can be used to control compressor operation. Thus "error" is the difference between the actual humidity sensed in the room or space and the humidity set point (i.e., the desired humidity level). This signal is then used to reset the suction pressure cut in point for the second compressor. If the error is large, which means humidity is not being reduced, the reset action will move the suction cut in pressure to a lower setting. On the other hand if the error is small, or the unit cycles on or off rapidity, reset will increase the suction pressure cut in. In this way the unit operates at the highest suction pressure possible producing the most stable conditions and increased energy savings.

Figure 12:
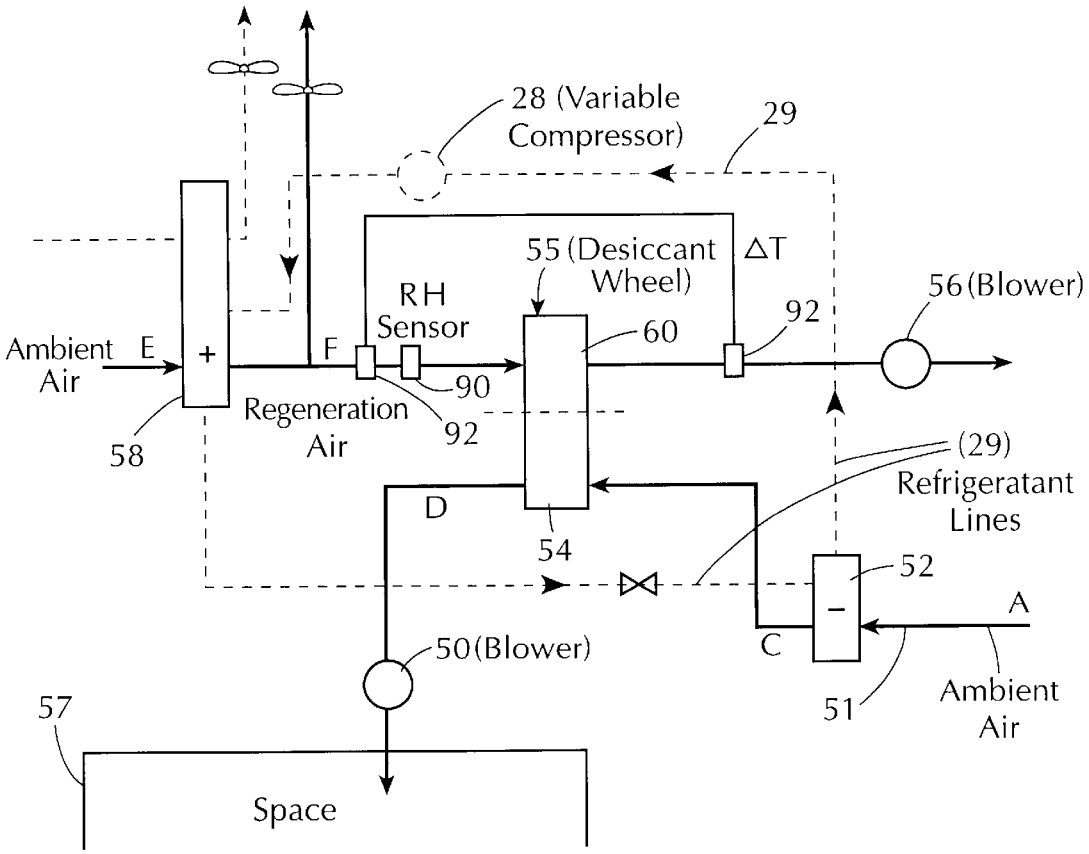
FIG. 12 is a schematic diagram similar to FIG. 1 showing yet another embodiment of the invention using a reactivation temperature control scheme.

A still further embodiment of the present invention is illustrated in FIG. 12, which also allows operation of the unit in cooling or dehumidification, or in both modes simultaneously.

Existing technology has traditionally controlled the discharge pressure of refrigeration systems (i.e., the pressure of gas leaving the evaporator or cooling coil) to prevent excessively low discharge pressure during winter. One common technique of head pressure regulation is to reduce condenser fan speed, which produces the beneficial side effect of reducing the power needed to operate the fan.

For humidity control units reducing fan speed has the same effect and benefit at low temperatures. However, because cooling applications and the humidity control units as used in the present invention have the ability to operate in cooling, dehumidification, or both modes simultaneously, a variation on the industry-accepted practice of pressure head regulation is needed.

When not limited by high outside ambient temperatures or a condenser's particular design criteria it is desirable to maintain the discharge pressure of the compressor at the equivalent of between 80° F. and 100° F. saturated discharge temperature. The control system of this embodiment will, in the cooling mode, optimize cooling performance by setting the head pressure set point within this range. Maximum efficiency is achieved at lower pressure ratios, which are characterized by higher suction pressures and lower discharge pressures.

On the other hand a desiccant wheel humidity control unit relies on creating a sufficient difference between the supply air's entering relative humidity and the regeneration air's relative humidity. This is the force driving moisture transfer in the desiccant wheel. It also is beneficial to operate the refrigeration system across the lowest pressure ratio possible. This means that higher suction pressures and lower condensing pressures should be used. The system of the present invention balances the performance of the entire unit without giving preference to either the refrigeration system or the desiccant system.

To accomplish this a humidity sensor 90 is placed in the regeneration air stream, after the heating condenser coil 58. An exemplary target RH value would be in the range of 10 to 30 percent RH. Assuming that saturation of the cooled air leaving the cooling coil 52 is achieved (Point 2 on the psychrometric charts) the space humidity sensor in space 57 would reset the head pressure to attain a specific RH sensed entering the wheel. The reset would be limited to keep the head pressure within a predefined range of conditions. For example, with R-22 refrigerant the range of head pressure limits would be from 168 psig (90° F.) to 360 psig (145° F.). These are generally accepted conditions of operation for known scroll compressors. This achieves a range of leaving air temperatures from the condenser coil or inlet to the wheel of 80° F. to 140° F. and avoids drawing up condenser head pressures with attendant loss of performance in the refrigeration system. Thus the compressor would run at the lowest head pressure while still producing the target relative humidity. The savings would be that the 45° F. leaving air temperature obtained with a head pressure of 260 psig reaches the target RH % at a lower pressure thereby reducing compressor power input while increasing refrigeration capacity.

Another way of accomplishing the same result would be by utilizing the differential or elasticity of reactivation outlet or differential temperature to reactive inlet temperature. For example, the desiccant wheel will presumably have a lower outlet air temperature when the wheel is still wet. Conversely the outlet air temperature will begin to climb when the wheel is fully reactivated, i.e., dry. The temperature of the air on either side of the wheel could be detected by conventional temperature sensors 92 and continuously monitored. When air increase in reactivation inlet air temperature yields a nearly similar increase in outlet air temperature it indicates that the energy is not being used to displace moisture from the wheel and therefore that head pressure should be reduced by appropriate control of the compression.

Alternatively the control could be set to maintain a target 20° F. differential in temperature across the wheel.

This system reduces lost energy by matching reactivation energy to load to reduce reactivation temperatures which in turn reduces head pressure that results in improved refrigeration performance.

Although illustrative embodiments of the present invention have been described herein with reference to the accompanying drawings, it is to be understood that the invention is not limited to those precise embodiments, but that various changes and modifications can be effected therein by those skilled in the art without departing from the scope or spirit of this invention.

What is claimed is:

1. An air conditioning and dehumidification system comprising an enclosed housing having a wall dividing the housing into first and second separate air plenums; a refrigeration circuit in the housing including an evaporator coil in the first plenum and a condenser coil, at least one refrigerant compressor, and condenser fan located in series in the second chamber such that the condenser fan draws supply air over the condenser coil from outside the housing through the second plenum and discharges it outside the housing; and a dehumidification system in the housing including a desiccant wheel rotatably mounted in the housing to rotate in a plane traversing perpendicular to said central wall whereby one segment of the wheel functioning as the process segment is located in the first plenum and a second segment of the wheel functioning as the process segment is located in the first plenum and a second segment of the wheel functioning as the regeneration segment is located in the second plenum; a supply/process air fan in the first plenum located adjacent one side of the wheel and a sub-divider wall in said first plenum extending from near said one side of the wheel to divide a sub-plenum in said first plenum whereby the process air fan draws a supply/process air stream into the first plenum, through the process section of the wheel into the sub plenum and then discharges the thus cooled and dried supply/process air to an enclosure; said desiccant wheel segment in the second plenum being located downstream of the air flowing over the condenser coils, a regeneration fan in said second plenum adjacent the downstream side of the desiccant wheel and baffle means in the second chamber extending from the desiccant wheel, downstream thereof towards a side wall of the housing for preventing back flow of air leaving the wheel toward the condenser coil or the inlet side of the wheel when the regeneration fan draws air leaving the condenser coil through the wheel to regenerate it.

2. A device for selecting heating, cooling and dehumidifying air enclosed space comprising a desiccant wheel based dehumidification system and at least one refrigeration circuit, said desiccant wheel dehumidification system including a desiccant wheel having a process section and a regeneration section, a blower for drawing air from said space through the regeneration section of the wheel; said refrigeration circuit including a first circuit including a condenser coil positioned between the enclosure and the regeneration section of the wheel in the path of regeneration air from the enclosure flowing to said regeneration section, an evaporator coil, blower means for drawing supply air over the evaporator coil, through the process section of the desiccant wheel to the enclosure, and a compressor for moving refrigerant in a circuit between the condenser and evaporation coils; and a second refrigeration circuit including a condenser coil, blower means for drawing ambient air over that condenser coil and exhausting the same to the atmosphere, an evaporator coil located in the supply air stream in the first regeneration system upstream of the desiccant wheel and a compressor for moving refrigerant between its associated coils, whereby operation of only said first refrigeration system produces cooling only; operation of only the desiccant wheel based system and the first refrigeration circuit produces dehumidification only; operation of the desiccant wheel based system and the first and second refrigeration system results in both cooling and dehumidification; operation of the desiccant wheel based system only produces enthalpy exchange between the regeneration air stream and the supply air stream; operation of neither the desiccant wheel systems, nor the refrigerant circuits, and only operation of said blowers, produces only fresh air circulation.

3. A device for selecting heating, cooling and dehumidifying air enclosed space comprising a desiccant wheel based dehumidification system and at least two refrigeration circuits, said desiccant wheel dehumidification system including a desiccant wheel having a process section and a regeneration section, a blower for drawing air from said space through the regeneration section of the wheel; said refrigeration circuits including a first circuit including a condenser coil positioned between the enclosure and the regeneration section of the wheel in the path of regeneration air from the enclosure flowing to said regeneration section, an evaporator coil, blower means for drawing supply air over the evaporator coil, through the process section of the desiccant wheel to the enclosure, and a compressor for moving refrigerant in a circuit between the condenser and evaporation coils; and at least a second refrigeration circuit including a condenser coil, blower means for drawing ambient air over that condenser coil and exhausting the same to the atmosphere, an evaporator coil located in the supply air stream in the first regeneration system upstream of the desiccant wheel and a compressor for moving refrigerant between its associated coils, whereby operation of only said first refrigeration system produces cooling only; operation of only the desiccant wheel based system and the first refrigeration circuit produces dehumidification only; operation of the desiccant wheel based system and the first and second refrigeration system results in both cooling and dehumidification; operation of the desiccant wheel based system only produces enthalpy exchange between the regeneration air stream and the supply air stream; operation of neither the desiccant wheel systems, nor the refrigerant circuits, and only operation of said blowers, produces only fresh air circulation.

4. A method for conditioning air for an enclosure comprising the steps of cooling a supply air stream with a refrigerant system containing a variable compressor by passing the air over a cooling coil to reduce the temperature thereof, passing the thus cooled supply air stream through a segment of a rotating desiccant wheel under conditions which increase its temperature and reduce its moisture content, and then delivering the thus treated air to said enclosure; regenerating the desiccant wheel by heating a regeneration air stream with the condensing coil of the refrigerant system, and then passing the heated regeneration air stream through another segment of the rotating desiccant wheel to regenerate the desiccant in the wheel; sensing at least one condition of the supply air stream, the regeneration air stream, and/or the refrigerant system; controlling the output of the compressor in response to the sensed condition; and the step of using at least two compressors in the refrigerant system and selectively operating one or both of the compressors in response to the differences in actual humidity in the enclosure and a predetermined humidity set point.

* * * * *